US009732940B2

(12) United States Patent
Yang et al.

(10) Patent No.: US 9,732,940 B2
(45) Date of Patent: Aug. 15, 2017

(54) LIGHTING APPARATUS AND WAVELENGTH CONVERTING APPARATUS THEREOF

(71) Applicant: Lextar Electronics Corporation, Hsinchu (TW)

(72) Inventors: Kuang-Neng Yang, Zhudong Township (TW); Kun-Hua Wu, Zhubei (TW); Jo-Hsiang Chen, New Taipei (TW); Tai-Hua Ho, Hukou Township (TW); Tzong-Liang Tsai, Taichung (TW); Chih-Hao Lin, Taipei (TW)

(73) Assignee: LEXTAR ELECTRONICS CORPORATION, Hsinchu (TW)

( * ) Notice: Subject to any disclaimer, the term of this patent is extended or adjusted under 35 U.S.C. 154(b) by 222 days.

(21) Appl. No.: 14/337,648

(22) Filed: Jul. 22, 2014

(65) Prior Publication Data

US 2015/0124476 A1 May 7, 2015

(30) Foreign Application Priority Data

Nov. 4, 2013 (TW) ..... 102139968 A

(51) Int. Cl.

| | |
|---|---|
| ***F21V 9/16*** | (2006.01) |
| ***F21K 9/20*** | (2016.01) |
| ***F21K 9/64*** | (2016.01) |
| *F21Y 103/00* | (2016.01) |
| *F21Y 115/10* | (2016.01) |

(52) U.S. Cl.

CPC ..... *F21V 9/16* (2013.01); *F21K 9/20* (2016.08); *F21K 9/64* (2016.08); *F21Y 2103/00* (2013.01); *F21Y 2115/10* (2016.08)

(58) Field of Classification Search

CPC ..... F21K 9/56; F21K 9/10; F21K 9/20; F21K 9/64; F21V 9/16; F21Y 2103/00; F21Y 2101/02; F21Y 2101/00; F21Y 2115/10

See application file for complete search history.

(56) References Cited

U.S. PATENT DOCUMENTS

| | | | | |
|---|---|---|---|---|
| 2002/0057059 | A1* | 5/2002 | Ogishi | H01J 61/28 313/636 |
| 2011/0193473 | A1* | 8/2011 | Sanders | F21K 9/135 313/483 |

FOREIGN PATENT DOCUMENTS

| | | | |
|---|---|---|---|
| JP | 8102553 | A | 4/1996 |
| TW | 530426 | B | 5/2003 |
| TW | M287952 | U | 2/2006 |
| TW | M320750 | U | 10/2007 |
| TW | I330705 | | 9/2010 |
| TW | M413802 | U | 10/2011 |
| TW | 201228044 | A | 7/2012 |

* cited by examiner

*Primary Examiner* — Stephen F Husar
(74) *Attorney, Agent, or Firm* — Moser Taboada

(57) ABSTRACT

A lighting apparatus includes a wavelength converting apparatus. The wavelength converting apparatus includes a hollow tube and a wavelength converting material. The hollow tube has an accommodating chamber. The wavelength converting material is positioned in the accommodating chamber.

5 Claims, 3 Drawing Sheets

LIGHTING APPARATUS AND WAVELENGTH CONVERTING APPARATUS THEREOF

RELATED APPLICATIONS

This application claims priority to Taiwan Application Serial Number 102139968, filed Nov. 04, 2013, which is herein incorporated by reference.

BACKGROUND

Technical Field

Embodiments of the present invention relate to a lighting apparatus. More particularly, embodiments of the present invention relate to the lighting apparatus and the wavelength converting apparatus thereof.

Description of Related Art

Because the light emitting diode (LED) has low power consumption, it has replaced the typical light source having high power consumption, such as the fluorescent lamp, and has been widely applied in the illumination technology and backlight module.

In a backlight module, a phosphor is disposed on the LED. However, because the phosphor is not moisture resistant and heat resistant, when the phosphor is positioned in a hot and wet environment, it may be damaged, which affects the light outputting ability of the backlight module.

SUMMARY

One aspect of the present invention is to prevent the phosphor from being affected by heat and moisture and being damaged.

In accordance with one embodiment of the present invention, a wavelength converting apparatus includes a hollow tube and a wavelength converting material. The hollow tube has an accommodating chamber. The wavelength converting material is positioned in the accommodating chamber.

In accordance with another embodiment of the present invention, a lighting apparatus includes a light emitting diode element and a wavelength converting apparatus. The light emitting diode element is used for emitting a first light with a wavelength λ1 along a lighting path. The wavelength converting apparatus as described above is disposed on the lighting path. A portion of the first light is converted to be a second light with a wavelength λ2 after the portion of the first light goes through the wavelength converting material in the wavelength converting apparatus. The first light and the second light are mixed to be a third light with a wavelength range covering the wavelength λ1 and the wavelength λ2.

In the foregoing embodiments, because the wavelength converting material, such as the phosphor, is positioned in the accommodating chamber of the hollow tube, the wall of the hollow tube can block it from the ambient moisture and the ambient heat, so as to prevent the damage to the wavelength converting material caused by the ambient moisture and the ambient heat.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
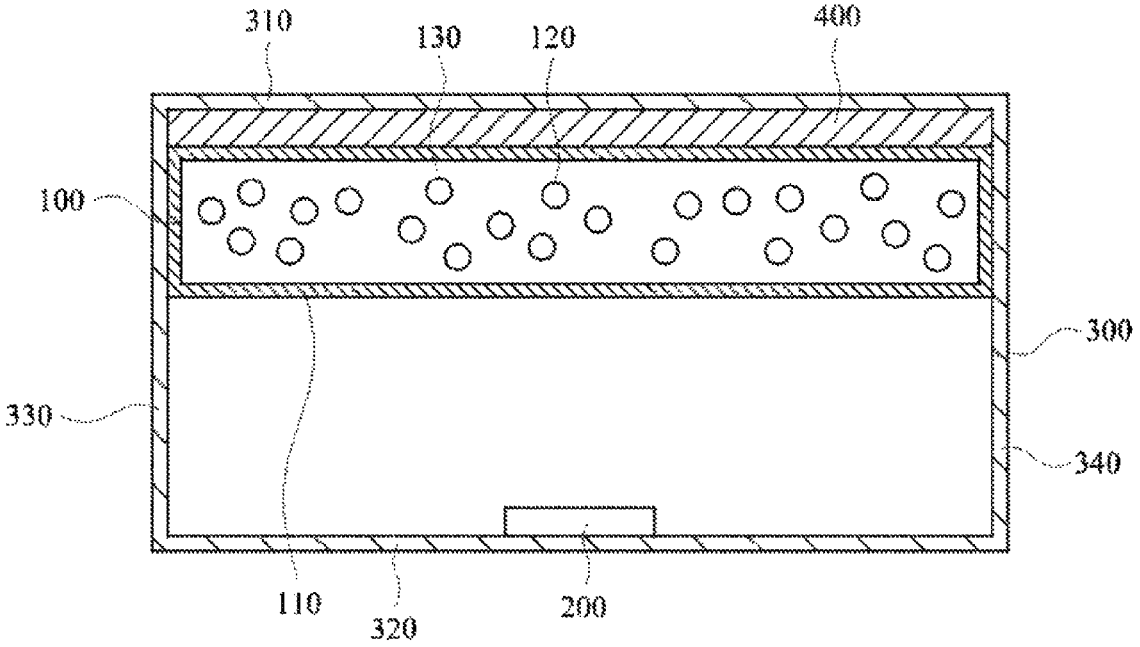
FIG. 1 is a cross-sectional view of the lighting apparatus in accordance with one embodiment of the present invention.

Reference will now be made in detail to the present embodiments of the invention, examples of which are illustrated in the accompanying drawings. Wherever possible, the same reference numbers are used in the drawings and the description to refer to the same or like parts.

Figure 2:
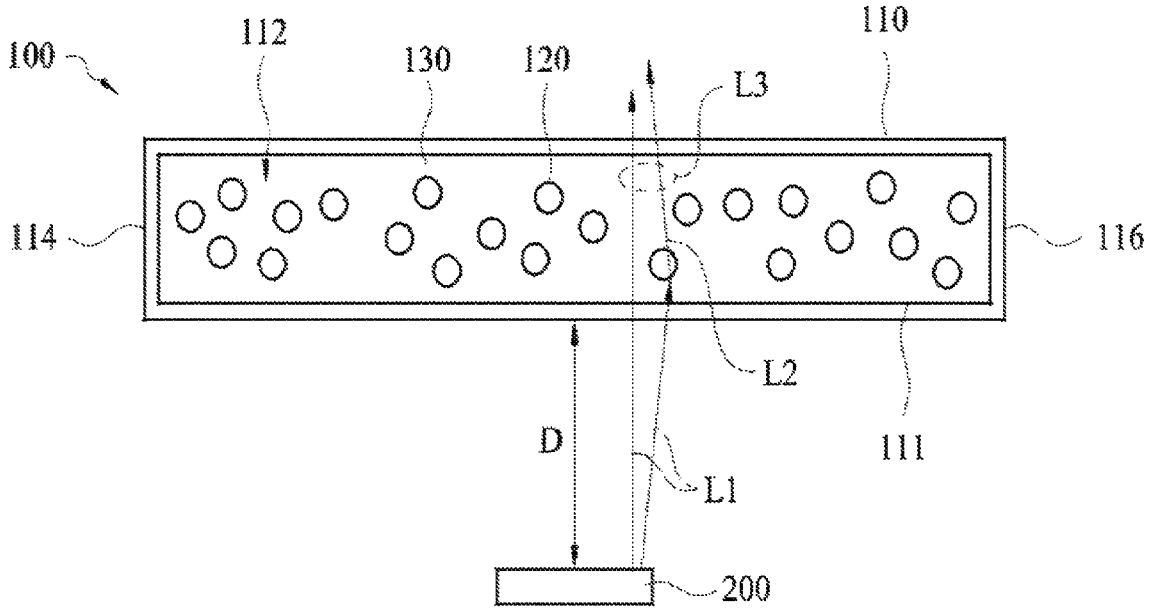
FIG. 2 is a light path diagram of the wavelength converting apparatus and the light emitting diode element.

FIG. 1 is a cross-sectional view of the lighting apparatus in accordance with one embodiment of the present invention. FIG. 2 is a light path diagram of the wavelength converting apparatus 100 and the light emitting diode 200. As shown in FIG. 1, the lighting apparatus includes a wavelength converting apparatus 100, a light emitting diode element 200 and a housing 300. The housing 300 accommodates the wavelength converting apparatus 100 and the light emitting diode element 200. As shown in FIG. 2, the wavelength converting apparatus 100 is disposed on the lighting path of the light emitting diode element 200, and the wavelength converting apparatus 100 includes a wavelength converting material 120, which can be used to convert the wavelength of the light emitted by the light emitting diode element 200. In particular, as shown in FIG. 2, the light emitting diode element 200 can emit a first light L1 with a wavelength λ1 along the lighting path. When the first light L1 goes into the wavelength converting apparatus 100, a portion of the first light L1 goes through the wavelength converting material 120 in the wavelength converting apparatus 100, and it is converted to be a second light L2 with a wavelength λ2. The first light L1 and the second light L2 are mixed to be a third light L3 with a wavelength range covering the wavelength λ1 and the wavelength λ2. For example, the first light L1 can be blue light, and a portion of the blue light (the first light L1) can be converted to be the yellow light (the second light L2) by the wavelength converting material 120, and another portion of the blue light (the first light L1) and the yellow light (the second light L2) can be mixed to be the white light (the third light L3).

In some embodiments, the wavelength converting material 120 can be a phosphor. For example, the wavelength converting material 120 can be, but is not limited to be, the phosphor including sulfide, nitride, nitrogen oxide, silicate or garnet. Because when the wavelength converting material 120 is positioned in a hot or wet environment, it may be damaged, which affects the light outputting ability of the lighting apparatus. As such, one aspect of the present invention provides the following solution to prevent the ambient moisture and the ambient heat affecting the wavelength converting material 120.

In particular, as shown in FIG. 2, the wavelength converting apparatus 100 may includes a hollow tube 110. The hollow tube 110 has an accommodating chamber 112. The wavelength converting material 120 is positioned in the accommodating chamber 112 of the hollow tube 110. As a result, the wall of the hollow tube 110 can block the wavelength converting material 120 from the ambient moisture and the ambient heat, so as to prevent the damage to the wavelength converting material 120 caused by the ambient moisture and the ambient heat.

In some embodiments, the hollow tube 110 can be a sealed tube, so as to improve the moisture resistant ability. For example, the hollow tube 110 has two opposite ends 114 and 116. The ends 114 and 116 are sealed. As a result, the hollow tube 110 does not provide any opening to make the moisture penetrating into the accommodating chamber 112, which affects the wavelength converting material 120.

In some embodiments, as shown in FIG. 2, the wavelength converting apparatus 100 further includes a light transmissive filler 130. The light transmissive filler 130 is filled in the accommodating chamber 112 of the hollow tube 110, and it contacts with an inner wall 111 of the hollow tube 110. In other words, the accommodating chamber 112 of the hollow tube 110 can be filled by the light transmissive filler 130, and the wavelength converting material 120 (such as the phosphor) can be blended in the light transmissive filler 130. The light transmissive filler 130 not only allows the light to go therethrough, but also blocks the moisture. For example, the material of the light transmissive filler 130 may include, but is not limited to include, acrylic, polycarbonate, polyethylene terephthalate, silicone or epoxy.

In some embodiments, the light emitting diode element 200 and the wavelength converting apparatus 100 are spatially separated, so as to prevent the heat generated by the light emitting diode element 200 from being transferred to the wavelength converting apparatus 100, such that the wavelength converting material 120 may not be damaged due to the heat. In other words, the light emitting diode element 200 is separated from the wavelength converting material 100 at a distance D, so as to prevent the heat generated by the light emitting diode element 200 from affecting the wavelength converting material 120.

In some embodiments, the accommodating chamber 112 is a vacuum chamber, so as to prevent the wavelength converting material 120 from chemically reacting with the air. In some embodiments, the accommodating chamber 112 is a non-vacuum chamber. The accommodating chamber 112 can be filled with nitrogen gas or inert gas, so as to prevent the wavelength converting material 120 from chemical reaction.

In some embodiments, as shown in FIG. 2, the hollow tube 110 is a light transmissive tube, which allows the first light L1 emitted by the light emitting diode element 200 to go through the wall of the hollow tube 110 and to get into the accommodating chamber 112. Further, the light transmissive tube can allow the third light L3 to go through the wall of the hollow tube 110 and to escape out of the accommodating chamber 112. For example, the material of the hollow tube 110 may include, but is not limited to include, glass, quartz, sapphire, acrylic, or polyethylene terephthalate. The foregoing material is not only light transmissive, but also has low thermal conductivity, so as to further prevent the heat generated by the light emitting diode element 200 from affecting the wavelength converting material 120.

In some embodiments, as shown in FIG. 1, the housing 300 has at least one light transmissive plate 310, a bottom plate 320 and two lateral plates 330 and 340. The lateral plates 330 and 340 are disposed on the bottom plate 320, and the light transmissive plate 310 connects the lateral plates 330 and 340. The light transmissive plate 310 is positioned above the wavelength converting apparatus 100. In such a configuration, the light going out of the wavelength converting apparatus 100 can go through the light transmissive plate 310 to the environment.

In some embodiments, as shown in FIG. 1, the lighting apparatus further includes a light diffusing plate 400. The wavelength converting apparatus 100 is positioned between the light diffusing plate 400 and the light emitting diode element 200, and the light diffusing plate 400 is positioned between the light transmissive plate 310 of the housing 300 and the wavelength converting apparatus 100. As a result, the light emitted by the light emitting diode element 200 can be diffused by the light diffusing plate 400 after going through the wavelength converting apparatus 100. The diffused light can go into the environment through the light transmissive plate 310, so that the light transmissive plate 310 can be a planar light source with uniform light distribution.

Figure 3:
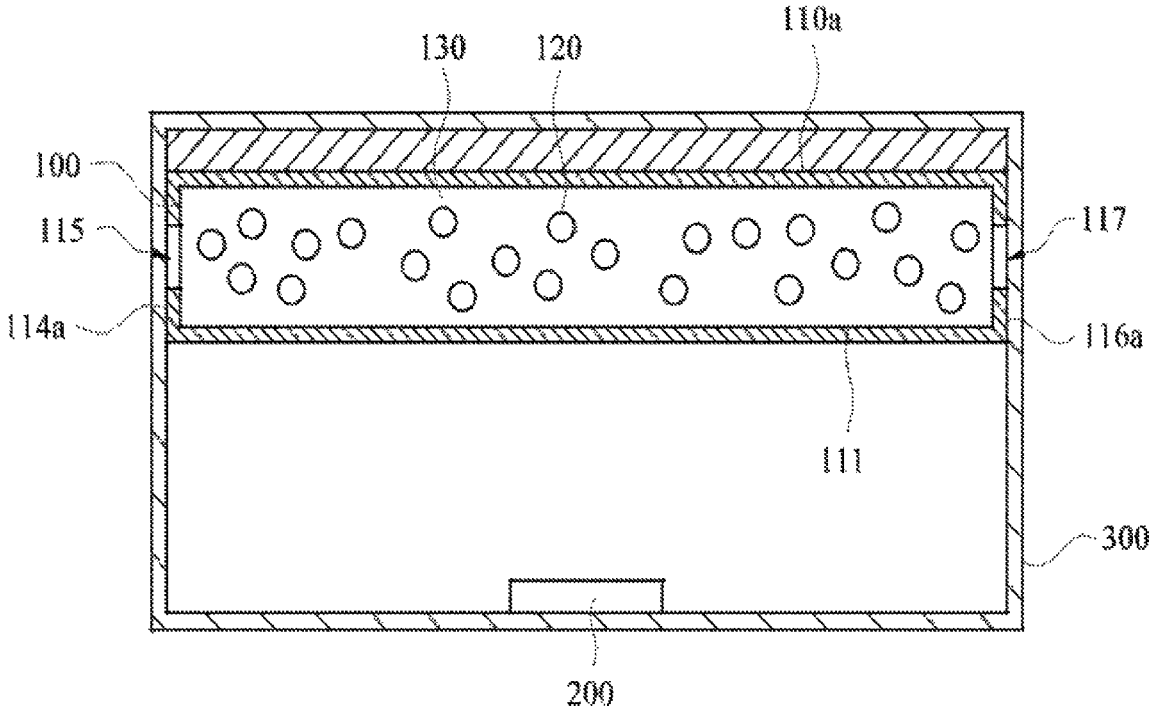
FIG. 3 is a cross-sectional view of the lighting apparatus in accordance with another embodiment of the present invention.

FIG. 3 is a cross-sectional view of the lighting apparatus in accordance with another embodiment of the present invention. The main difference between this embodiment and which is shown in FIG. 1 is that: the end 114*a* has an opening 115, and the end 116*a* has an opening 117 as well. In other words, the hollow tube 110*a* is not a sealed tube, which does not require a sealing process, thereby simplifying the manufacturing process.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A lighting apparatus, comprising:

a light emitting diode element for emitting a first light with a wavelength $\lambda 1$ along a lighting path;

a wavelength converting apparatus disposed on the lighting path, wherein the wavelength converting apparatus comprises a hollow tube and a wavelength converting material, the hollow tube has an accommodating chamber, and the wavelength converting material is positioned in the accommodating chamber, wherein a portion of the first light is converted to be a second light with a wavelength $\lambda 2$ after the portion of the first light goes through the wavelength converting material in the wavelength converting apparatus, wherein the first light and the second light are mixed to be a third light with a wavelength range covering the wavelength $\lambda 1$ and the wavelength $\lambda 2$; and a light diffusing plate, wherein the wavelength converting apparatus is positioned between the light diffusing plate and the light emitting diode element.

2. The lighting apparatus of claim 1, wherein the light emitting diode element and the wavelength converting apparatus are spatially separated.

3. The lighting apparatus of claim 1, wherein the first light is blue light.

4. The lighting apparatus of claim 3, wherein the third light is white light.

5. The lighting apparatus of claim 1, further comprising a housing accommodating the wavelength converting apparatus and the light emitting diode element, wherein the housing has at least one light transmissive plate, and the light diffusing plate is positioned between the light transmissive plate and the wavelength converting apparatus.

* * * * *